US010987206B2

(12) United States Patent
Van Kappel-Dufour et al.

(10) Patent No.: US 10,987,206 B2
(45) Date of Patent: Apr. 27, 2021

(54) STRAW FOR THE PRESERVATION OF A PREDETERMINED DOSE OF LIQUID-BASED SUBSTANCE, AS WELL AS A METHOD AND INJECTION DEVICE THAT EMPLOY IT

(71) Applicant: IMV TECHNOLOGIES, Saint Ouen sur Iton (FR)

(72) Inventors: Anne Linda Van Kappel-Dufour, Lyons (FR); Jean-Charles Gorges, Chenay (FR); Eric Schmitt, Villaines-la-Juhel (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 400 days.

(21) Appl. No.: 15/578,804

(22) PCT Filed: Jun. 2, 2016

(86) PCT No.: PCT/FR2016/051321
§ 371 (c)(1),
(2) Date: Dec. 1, 2017

(87) PCT Pub. No.: WO2016/193630
PCT Pub. Date: Dec. 8, 2016

(65) Prior Publication Data

US 2018/0110604 A1 Apr. 26, 2018

(30) Foreign Application Priority Data

Jun. 3, 2015 (FR) ..... 1555026

(51) Int. Cl.
*A61D 19/02* (2006.01)
*B01L 3/00* (2006.01)

(52) U.S. Cl.
CPC ..... *A61D 19/024* (2013.01); *A61D 19/027* (2013.01); *B01L 3/502707* (2013.01); *B01L 2300/0832* (2013.01)

(58) Field of Classification Search
CPC ..... A61D 19/024; A61D 19/027
See application file for complete search history.

(56) References Cited

U.S. PATENT DOCUMENTS 2,717,601 A * 9/1955 Brown ..... A61M 5/2448 206/221
3,805,784 A * 4/1974 Alter ..... A61B 17/43 604/403
4,022,206 A 5/1977 Hilleman et al.
(Continued)

FOREIGN PATENT DOCUMENTS

CN 2105940 U 6/1992
CN 201384592 Y 1/2010
(Continued)

*Primary Examiner* — Holly Kipouros
(74) *Attorney, Agent, or Firm* — Browdy and Neimark, P.L.L.C.

(57) ABSTRACT

The straw comprises a tube (11) and a stopper (12) fixed relative to the tube (11) and comprising a male connector tip (29) configured in order that a syringe needle (44) having a female connector tip (45) with a frusto-conical internal surface in accordance with a standard can be connected to said stopper (12) by engagement of the female connector tip (45) of the needle on the male connector tip (29) of the stopper (12).
The injection device comprises such a straw (10) and a syringe needle (44).
The method of emptying the straw comprises the step of pushing the dose of liquid-based substance (21) packaged in the straw (10) towards the stopper (12).

17 Claims, 8 Drawing Sheets

(56) References Cited

U.S. PATENT DOCUMENTS

| | | | | |
|---|---|---|---|---|
| 4,378,798 | A * | 4/1983 | Cassou | A61D 19/027 604/217 |
| 5,190,880 | A | 3/1993 | Cassou et al. | |
| 5,195,957 | A | 3/1993 | Tollini | |
| 5,261,881 | A | 11/1993 | Riner | |
| 6,300,125 | B1 | 10/2001 | Saint-Ramon et al. | |
| 6,305,585 | B1 | 10/2001 | Saint-Ramon | |
| 6,416,611 | B1 | 7/2002 | Saint-Ramon et al. | |
| 6,472,036 | B2 | 10/2002 | Saint-Ramon et al. | |
| 6,516,953 | B1 * | 2/2003 | DiCesare | B01D 21/0003 210/516 |
| 7,056,727 | B2 | 6/2006 | Saint-Ramon et al. | |
| 7,252,988 | B2 | 8/2007 | Saint-Ramon et al. | |
| 2003/0064526 | A1 * | 4/2003 | Niedbala | A61B 10/0045 436/165 |
| 2013/0289403 | A1 * | 10/2013 | Stroud | A61D 19/027 600/439 |
| 2015/0297332 | A1 | 10/2015 | Schmitt et al. | |

FOREIGN PATENT DOCUMENTS

| | | | |
|---|---|---|---|
| CN | 105188598 | A | 12/2015 |
| EP | 0873726 | A1 | 10/1998 |
| FR | 995878 | A | 12/1951 |
| FR | 2597328 | A1 | 10/1987 |
| FR | 2771284 | A1 | 5/1999 |
| FR | 2771285 | A1 | 5/1999 |
| FR | 2784572 | A1 | 4/2000 |
| FR | 2787717 | A1 | 6/2000 |
| FR | 2824255 | A1 | 11/2002 |
| FR | 2824256 | A1 | 11/2002 |
| FR | 2932064 | A1 | 12/2009 |
| FR | 2998473 | A1 | 5/2014 |
| GB | 669265 | A | 4/1952 |
| KR | 20120032712 | A | 4/2012 |
| WO | 2010070533 | A1 | 6/2010 |
| WO m | 2014167215 | A1 | 10/2014 |

* cited by examiner

STRAW FOR THE PRESERVATION OF A PREDETERMINED DOSE OF LIQUID-BASED SUBSTANCE, AS WELL AS A METHOD AND INJECTION DEVICE THAT EMPLOY IT

The invention generally relates to the preservation of a predetermined dose of liquid-based substance, and more particularly to the straws for performing such preservation.

It is known that such a straw comprises a tube and a stopper disposed in the tube. The stopper is usually of the three-part type originally described in French patent 995.878, corresponding to British patent 669,265, i.e. formed by two plugs made from a fibrous substance enclosing a powder which, on contact with a liquid, transforms into an impermeable paste or gel adhering to the wall of the tube so that the stopper is liquid-tight.

Similar but improved stoppers are described by the French patent applications 2 824 255 and 2 824 256, corresponding to the U.S. patents 2002/0183653 and 2002/0188222.

Stoppers of another type are also known, for example a stopper comprising or associated with an insert described by French patent application 2 771 284 corresponding to U.S. Pat. No. 6,300,125, by French patent application 2 771 285 corresponding to U.S. patent 2001/0014376, by French patent application 2 784 572 corresponding to U.S. Pat. No. 6,416,611 and by French patent application 2 932 064; or for instance a stopper made from a one-piece cylinder of hydrophobic microporous material described by European patent application 0 873 726; or lastly a stopper made from a one-piece cylinder of sintered self-sealing microporous material described by PCT application WO 2010/070533.

In the initial state, the stopper is disposed in the neighborhood of one of the ends of the tube and it is provided that in the filled state, the dose of liquid substance which must be preserved in the straw is disposed between the stopper and the other end of the tube (the end furthest from the stopper).

To fill the straw, the end closest to the stopper is placed in communication with a vacuum source while the end furthest from the stopper is placed in communication with a vessel containing the substance to be introduced into the straw.

The air initially contained between the stopper and the end of the tube furthest from the stopper is sucked through the stopper while the substance moves forward into the tube until it meets the stopper.

If necessary, after filling, the straw is welded close to one or both of its ends and is stored cold. The straw and in particular the material of the tube are provided such that this cold storage can be implemented by plunging the straw into a liquid cryogenic agent such as liquid nitrogen.

In order to empty the straw, if necessary after cutting the welded end portions and thawing, a rod is inserted into the tube via the end closest to the stopper, until it bears against the stopper. Using this rod, the plug is made to slide in the manner of a piston towards the end furthest from the stopper, which causes the expulsion of the dose of substance which had been introduced into the straw.

When the straw is used to preserve diluted animal semen, in particular bovine semen, emptying of the straw is carried out to perform an artificial insemination.

The invention aims to provide such a straw which provides the operators with new capabilities while remaining simple, convenient and economic to manufacture and use.

To that end the invention provides a straw for the preservation of a predetermined dose of liquid-based substance, comprising a tube extending between a first end and a second end and comprising a fluid-tight stopper disposed in the tube in the neighborhood of its first end and extending between a first end facing towards the first end of the tube and a second end facing towards the second end of the tube, characterized in that said stopper:

- is fixed relative to the tube;
- comprises a male connector tip extending between a first end facing towards the first end of the tube and a second end facing towards the second end of the tube, having a frusto-conical external surface in accordance with a standard increasing in diameter from the first end of the tip towards the second end of the tip, the tip being configured in order that a syringe needle having a female connector tip with a frusto-conical internal surface in accordance with a standard can be connected to said stopper by engagement of the female connector tip of the needle on the male connector tip of the stopper with the internal frusto-conical surface of the female tip in contact with the external frusto-conical surface of the male tip; and
- comprises an internal duct extending between the first end of the tip and the second end of the stopper.

The internal duct of the syringe needle can thus be placed in communication, via the internal duct of the stopper, with the internal space of the tube situated between the second end of the stopper and the second end of the tube.

This internal space of the tube is provided, as in conventional straws, to receive the predetermined dose of liquid-based substance.

If a syringe needle (for example an injection needle) is connected onto the tip of the stopper and the dose of substance contained in the straw is drawn towards the stopper, for example as explained below, the substance will pass through the internal duct of the stopper then the internal duct of the needle and it will be possible for it to be expulsed at the distal end of the needle, that is to say the pointed end situated at the opposite end to the female tip of the needle.

It will be noted that contrary to conventional straws, the stopper is not moved to push the dose of substance towards the second end of the tube but the stopper is fixed and it is the dose of substance which is pushed towards the stopper and thus towards the first end of the tube.

The straw according to the invention can thus play not only the role of a member for packaging the dose of substance enabling it to be preserved, including at cryogenic temperatures (conventional role for a straw), but also the role of a syringe body to which may be directly connected a syringe needle and of which the content may be ejected through the distal end of that needle.

Thus, for liquid-based substances which, after a period of preservation, including at cryogenic temperatures, must be injected with a needle for example into a bag containing a dilution liquid, the straw according to the invention makes it possible to avoid the dose of substance having to be transferred from the packaging unit that it constitutes to a syringe body.

This offers the advantage of simplifying the task of the operator and of saving having to provide the syringe body.

Furthermore, the manipulations on the liquid-based substance are reduced, which is in some cases favorable to the preservation of its properties, in particular if the substance contains constituents sensitive to the mechanical stresses produced on passage within a narrow duct such as the internal duct of an injection needle. Such a substance is for example a vaccine comprising cells that are sensitive to mechanical stresses.

The straw according to the invention makes it possible to take advantage of the packaging qualities for liquid-based substances offered by straws, of the compatibility with existing devices for cold preservation of straws including at cryogenic temperatures, for example the conventional beakers for holding straws in liquid nitrogen, while providing the capacities of a syringe body; this being simply by implementing, in a thin tube of a straw, a stopper configured accordingly.

According to advantageous features, in an initial state prior to use, the first end of the stopper is situated in the tube at a predetermined distance from the first end of the tube enabling the tube to be welded between the first end of the stopper and the first end of the tube.

When the straw is closed by welding at its ends and is plunged into the cryogenic agent such as liquid nitrogen, the tip and more generally the stopper is isolated from the liquid cryogenic agent by the tube of the straw and is thus protected from any cross-contamination liable to be conveyed by the liquid cryogenic agent.

It will be noted that if the tip was disposed out of the tube projecting beyond the first end of the tube, the straw according to the invention would have a greater holding capacity but could not provide such an isolating capacity for the tip.

According to advantageous features, in an initial state prior to use, the stopper comprises at its first end a closure to be removed that obturates said internal duct of the stopper.

This closure is of course to be removed before emptying the straw.

The presence of the closure until the operation of emptying the straw ensures that there is no substance that passes into the stopper before the emptying.

In particular, there is no lost substance in the part of the straw situated between the stopper and the first end of the tube.

According to advantageous features, an annular wall is disposed between the closure and the male tip, the internal duct of the stopper extending beyond the first end of the male tip, in the annular wall, to the closure which obturates it, the external surface of the annular wall being set back relative to the external surface of the male tip.

The closure is removed by cutting or even by tearing the annular wall.

The remaining piece of annular wall does not hinder the engagement of the female tip since the external surface of the annular wall is set back relative to the external surface of the male tip.

According to advantageous features, the stopper comprises a body fastened to the tube and an appendix projecting from said body fastened to the tube solely via the body, which appendix comprises said male tip and extends to the first end of the stopper.

Thus, the stopper can be efficiently fastened to the tube by the body while the tube leaves the external surface of the tip free. Furthermore, if needed, the tube can be removed around the appendix after having been cut.

According to advantageous features, the body of the stopper and the tube are fastened independently of any contact of the stopper with said liquid-based substance.

In other words, the degree of fastening between the tube and the stopper is the same without prior contact and after contact of the stopper with the liquid-based substance. Thus, contrary to the conventional stoppers of straws, there is no adhesion of a sealing agent to the tube once the stopper has been moistened.

It is indeed possible for example to fill the straw other than by suction of air through the stopper by the first end of the tube, for example by virtue of a needle which is inserted into the tube by its second end until the end of the needle is close to the stopper then the substance is injected into the tube at the same time as the needle withdraws.

The fastening of the stopper to the tube being independent of contact with the liquid substance, no precaution has to be taken with the straw according to the invention to ensure that the liquid substance has come into contact with the stopper. It is furthermore possible to deliberately leave the liquid substance at a distance from the stopper, for example to have an air bubble which is useful on freezing.

According to advantageous features:

- the body is rigid at least at the periphery and comprises an external surface having non-return projections oriented to enable the forced sliding of the stopper in relation to the tube from the first end towards the second end and to resist the sliding of the stopper in relation to the tube towards the first end of the tube;
- the body is rigid at least at the periphery and comprises an external surface having at least one annular rib having a straight surface facing towards the first end of the tube and an inclined surface facing towards the second end of the tube, the inclined surface being inclined towards the interior and towards the second end of the tube;
- the body is rigid at least at the periphery and comprises an external surface having at least two annular ribs spaced away from each other
- the body comprises on its external surface an annular groove near of the appendix.
- said male connector tip is a male Luer tip;
- said stopper is entirely of material impermeable to gases and liquids independently of contact of the stopper with said liquid-based substance; and/or
- said stopper is entirely of rigid plastic material molded as a single piece.

According to a second aspect, the invention is also is directed to a device for injecting a liquid-based substance comprising a straw as disclosed above and a syringe needle having a female connector tip with a frusto-conical internal surface engaged on the male connector tip of the stopper of said straw.

According to a third aspect, the invention is also directed to a method of emptying a straw as disclosed above, comprising a dose of liquid-based substance disposed between the second end of the stopper and the second end of the tube, comprising the step of pushing the dose of liquid-based substance towards the first end of the tube after having connected the female tip of a syringe needle onto the male tip of the stopper.

According to advantageous features:

- the step of pushing the dose of liquid-based substance is implemented with the second end of the tube remaining closed while the tube is progressively crushed from the second end of the tube towards the stopper; or
- the step of pushing the dose of liquid-based substance is implemented with the second end of the tube being open, by virtue of a piston inserted by that end which is moved towards the stopper.

The disclosure of the invention will now be continued with the description of embodiments given below, for the purposes of illustration and non-limitatively, with reference to the attached drawings in which.

Figure 1:
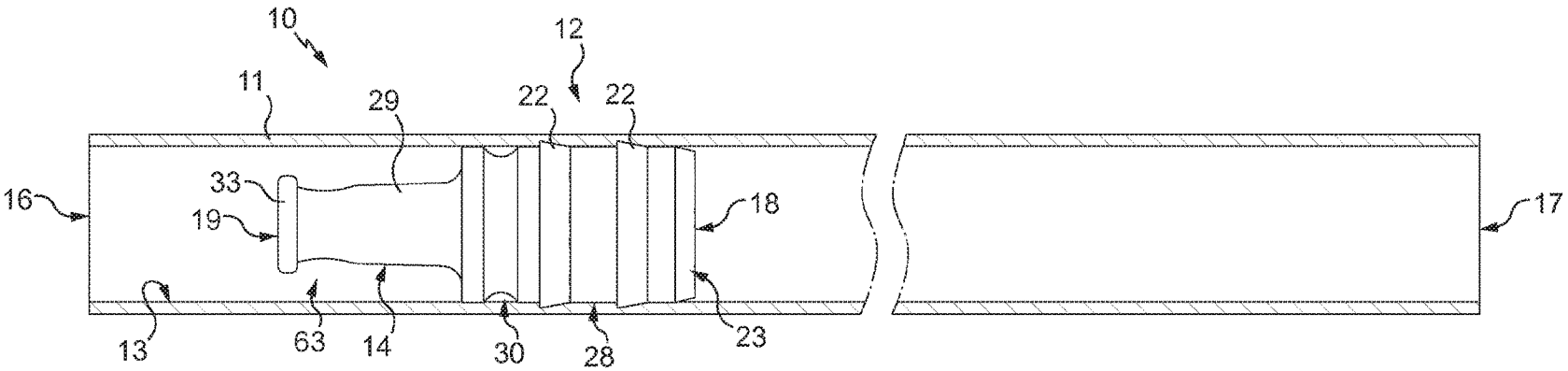
FIG. 1 is a diagrammatic view of a straw according to the invention, in the initial state before use in which it is empty and open at both ends.

The straw 10 illustrated in FIG. 1 in the initial state (before use) comprises a tube 11 and a stopper 12.

The tube 11 is of extruded plastic material with an inside diameter which is therefore determined. Here, the inside diameter is of the order of 8.20 mm and the length of the tube 11 is of the order of 130 mm.

The tube 11 extends between an end 16 (which can be seen on the left in FIG. 1) and an end 17 (which can be seen on the right in FIG. 1).

The material of the tube 11 is here of Surlyn®, which has good properties of weldability and an excellent compatibility with cryogenic temperatures. For more detail, reference may be made to the French patent application 2 651 793 to which corresponds U.S. Pat. No. 5,190,880.

As a variant, the material of the tube is of another thermo-weldable plastic material that withstands cryogenic temperatures, for example PVC, TPE or PP.

The stopper 12 is of a material which has the same properties of impermeability to gases and liquids with and without prior contact of the stopper with a liquid, in particular aqueous.

In particular, contrary to the conventional stoppers of straws, the stopper 12 does not comprise a sealing agent of powder in the dry state that transforms into paste or gel once moistened.

The material of the stopper 12 is of polyethylene here, and more specifically of HDPE. As a variant, the stopper 12 is of another relatively rigid thermoplastic material, for example polypropylene (PP).

The stopper 12 is disposed in the tube 11 in the neighborhood of its end 16. The stopper 12 extends between an end 19 facing towards the end 16 of the tube 11 and an end 18 facing towards the end 17 of the tube 11.

In the initial state (before use) of the straw 10, illustrated in FIG. 1, the end 19 of the stopper 12 is situated in the tube 11 at a certain distance from the end 16 of the tube 11.

Figure 6:
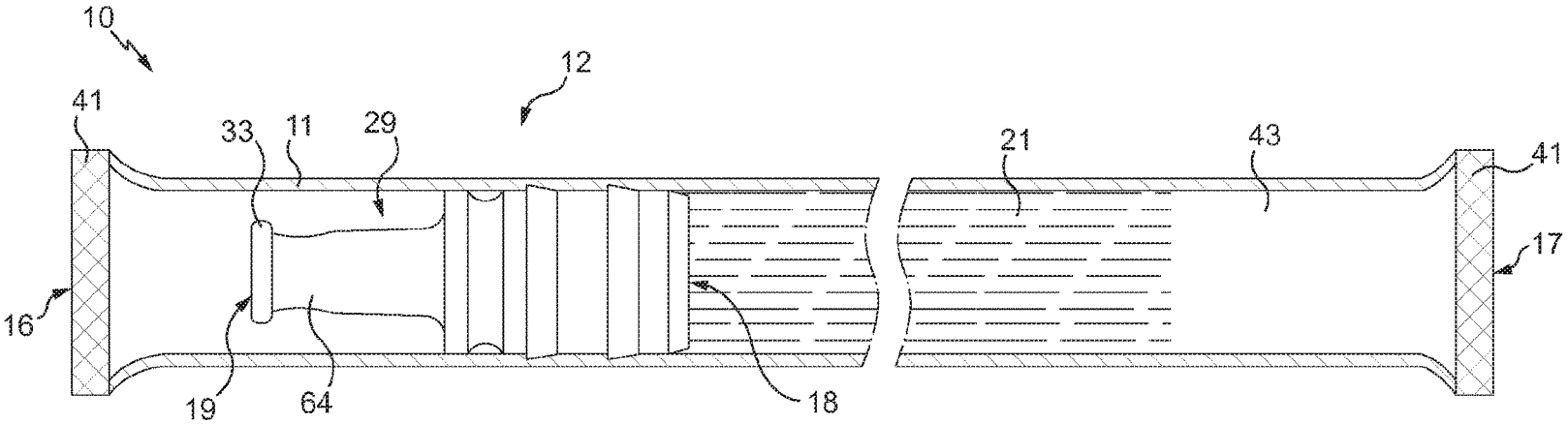
FIG. 6 is a similar view to FIG. 5 but with the tube of the straw welded at both ends.

This distance was predetermined in order for it to be sufficiently great for it to be possible to weld the tube 11 in the neighborhood of the end 16, as shown in FIG. 6.

In general the stopper 12 has an axisymmetrical configuration and it is coaxially disposed in the tube 11.

The stopper 12 comprises a body 9 and an appendix 63 projecting from the body 9 and extending to the end 19.

The appendix 63 comprises a male tip 29, a closure 33 situated at the end 19 and an annular wall 64 connecting the closure 33 and the male tip 29.

The body 9 is fastened directly to the tube 11. The appendix 63 projecting from the body 9 is connected to the tube 11 solely via the body 9.

Thus, the tube 11 leaves the external surface of the appendix 63 free, in particular the external surface 14 of the male tip 29.

Figure 4:
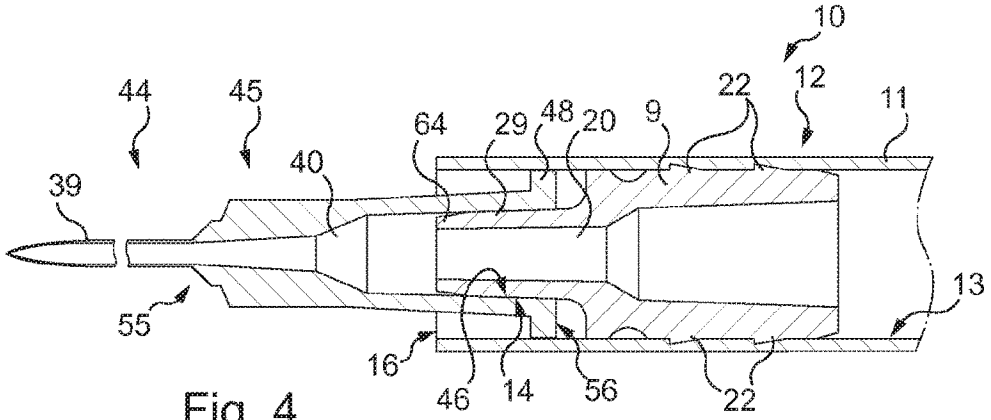
FIG. 4 is a cross-section view of the end of the straw that can be seen on the left in FIG. 1 except for the fact that a syringe needle has been connected to the stopper of that straw after the closure of its stopper has been cut then removed and its tube has been cut at the same location then the cut end portion of the tube removed.

As is explained in more detail later, the external surface 14 is frusto-conical in accordance with a standard in order to cooperate with the internal surface 46, which is frusto-conical in accordance with a standard, of the female tip 45 of a syringe needle 44 (FIG. 4).

Figure 13:
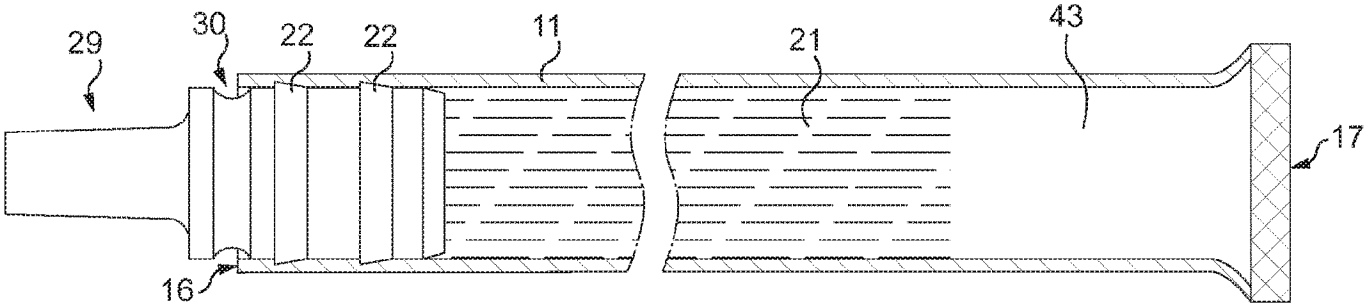
FIG. 13 is a similar view to FIG. 7 but with the tube cut at the location of the stopper body.
Figure 14:
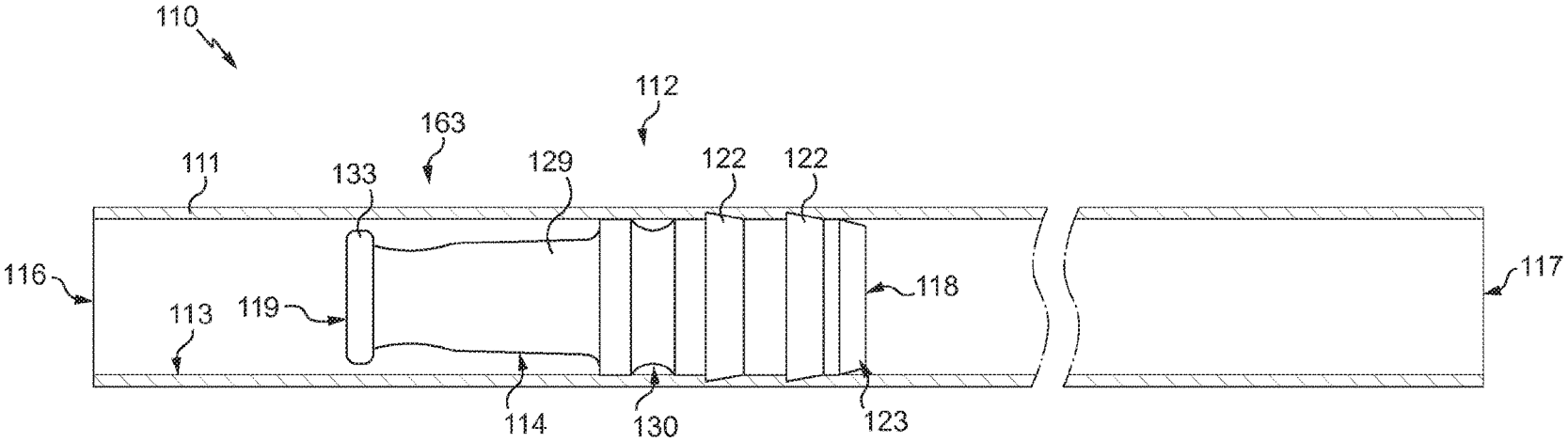
FIGS. 14 to 16 are similar views to FIGS. 1 to 3 but for a variant of the straw of smaller holding capacity.
Figure 16:
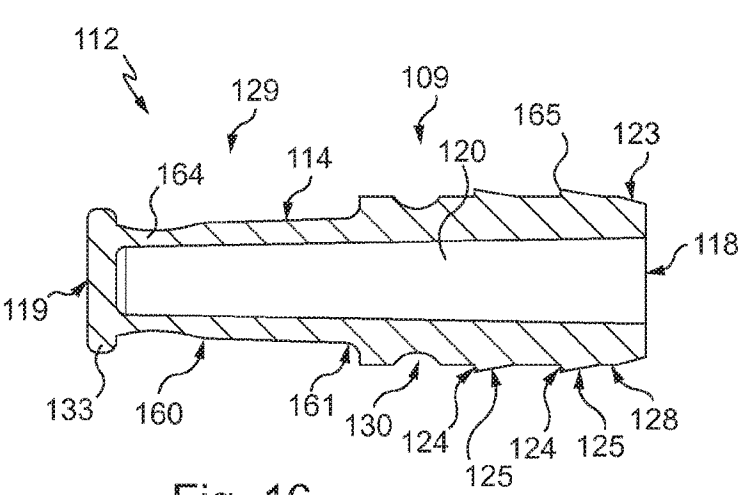
Figure 15:
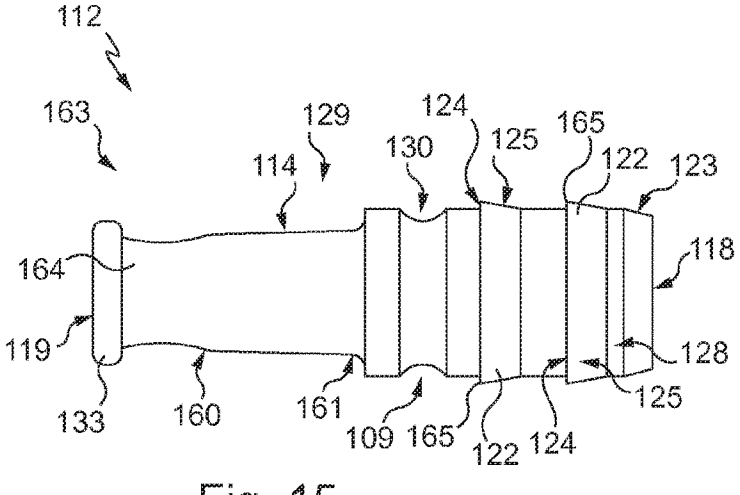

Furthermore, if necessary, the portion of the tube 11 surrounding the appendix 63 may be cut and removed, as shown in FIG. 13.

In the filled state of the straw 10 (FIG. 5), the dose of liquid-based substance 21 which must be preserved in the straw 10 is disposed between the stopper 12 and the end 17 of the tube 11 which is the furthest from the stopper 12.

The straw 10 has a useful holding capacity here of approximately 4 ml.

The implementation of the filling operation will be explained later.

If necessary, after filling, the tube 11 of the straw is welded in the neighborhood of one or both of its ends 16 and 17 (FIG. 6) and is placed in cold storage.

The implementation of the emptying of the straw 10, if necessary after thawing and cutting one or both welded end portions, will be explained later.

Of course, if the tube 11 has been welded at one end and the welded portion has then been cut and removed, the tube 11 then has a new end that is set back relative to the initial end. Similarly, if the tube 11 has been cut to remove an end portion initially situated around the appendix 63, the tube 11 then has a new end set back relative to the initial end. To simplify, below the numerical references 16 and 17 will also be employed for the new ends of the tube 11 each thus being set back relative to the respective initial end.

On manufacture of the straw 10, the stopper 12 is fitted into the tube 11 simply by insertion through the first end 16 of the tube 11 and forced sliding towards the second end 17 of the tube 11 to reach the location provided for the stopper 12 in the tube 11.

The fact that the stopper 12 can only slide in the tube 11 if a high force is applied (forced character of the sliding) makes it possible to provide sufficient holding in place of the stopper 12 in the tube 11 to withstand the forces applied on connecting a syringe needle 44 (FIG. 4) by engagement of the female connector tip 45 of the needle 44 on the male connector tip 29 of the stopper 12 with the internal frusto-conical surface 46 of the female tip 45 in contact with the external frusto-conical surface 14 of the male tip 29.

As explained below, the stopper 12 is configured to resist sliding towards the first end 16 of the tube 11. This enables the stopper 12 to withstand high forces applied on the end 18 of the stopper 12 by the substance 21 at the time of emptying (FIGS. 9 and 11) and, the case arising, during freezing in which an increase in volume of the substance 21 occurs which urges the stopper 12 towards the end 16 of the tube 11.

The male tip 29 extends between an end 60 facing towards the end 16 of the tube 11 and an end 61 facing towards the end 17 of the tube 11.

The frusto-conical external surface 14 of the male tip 29 increases in diameter from the end 60 of the tip 29 towards the end 61 of the tip 29.

Here, the conicity of the external surface 14 of the male tip 29 is in accordance with Luer dimensions, defined by the standard ISO 594-1:1986 or by the standards DIN and EN 1707:1996 and 20594-1:1993.

An internal duct 20 is provided in the stopper 12.

The internal duct 20 extends between the end 60 of the male tip 29 and the end 18 of the stopper 12.

The internal duct 20 thus passes through the male tip 29 and the body 9 opening into the internal space of the tube 11 provided to be filled by the substance 21.

The internal duct 20 continues beyond the end 60 of the male tip 29 in the annular wall 64 as far as the closure 33 which obturates it.

The closure 33 is formed here by a straight wall oriented transversely to the internal duct 20.

The closure 33 is to be removed before connecting the needle 44 and emptying the straw.

The internal duct 20 gets smaller in diameter from the end 18 of the stopper 12 to the end 60 of the male tip 29, by presenting three successive frusto-conical portions in stages.

The external surface of the annular wall 64 is set back relative to the external surface 14 of the male tip 29.

The closure 33 is removed by cutting or even by tearing the annular wall 64.

The remaining piece of annular wall 64 does not hinder the engagement of the female tip 45 since the external surface of the annular wall 64 is set back relative to the external surface 14 of the male tip (see la FIG. 4).

It will be noted that the thickness of the annular wall 64 is less than that of the male tip 29, which facilitates the cutting of the annular wall 64 to remove the closure 33.

Figure 2:
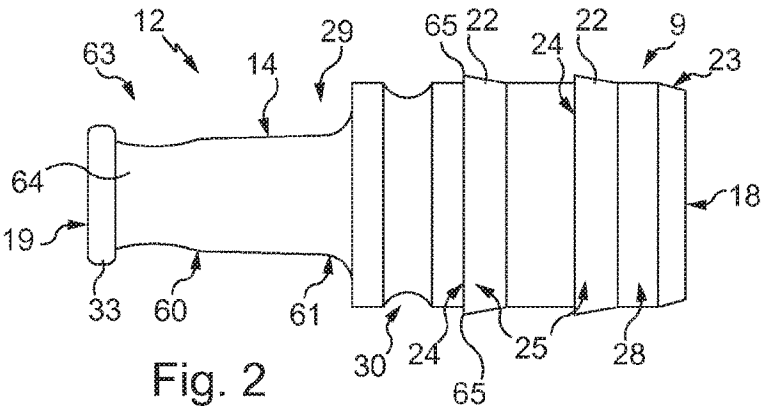
FIGS. 2 and 3 are respectively a lateral view and a cross-section view of the stopper of this straw, shown in isolation.
Figure 3:
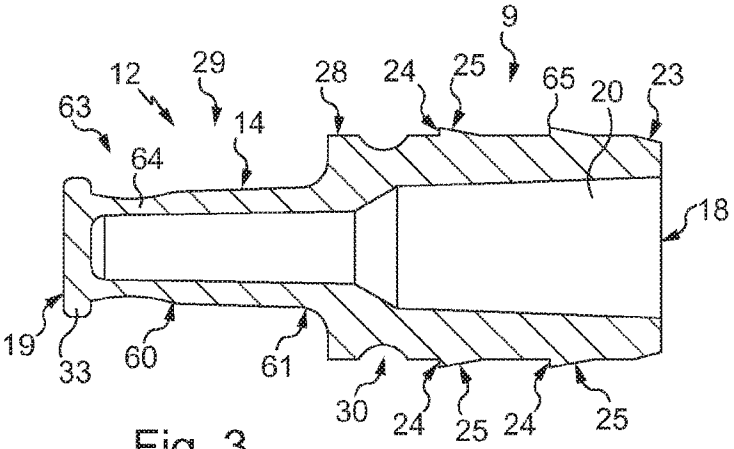

The body 9 will now be described in detail, with reference to FIGS. 2 and 3.

The body 9 extends between an end from which the appendix 63 projects (which end faces towards the end 16 of the tube 11) and the end 18 of the stopper 12.

The body 9 comprises a plurality of annular ribs 22, here two identical ribs, provided on its external surface 28.

The ribs 22 are disposed at a distance from each other, with a predetermined spacing between them. This spacing enables the stopper 12 to be stabilized in the tube 11.

Each annular rib 22 has a straight surface 24 facing towards the end 16 of the tube 11 and an inclined surface 25 facing towards the end 17 of the tube 11.

The surface 25 is inclined towards the interior and towards the end 17 of the tube 11.

For each rib 22, the straight surface 24 and the inclined surface 25 meet at an edge 65.

These annular ribs 22, shaped in this way, procure a non-return effect enabling the forced sliding of the stopper 12 relative to the tube 11 from the end 16 towards the end 17 and resisting the sliding of the stopper 12 relative to the tube 11 towards the end 16 of the tube 11.

The material in which the stopper 12 is made is relatively rigid and therefore the periphery of the body 9 is relatively rigid, and in any event more so than the wall of the tube 11 which is relatively thin.

It will be noted that the general diameter of the external surface 28 of the body 9 (diameter of surface 28 with the exception of the annular ribs 22 and the annular groove 30 of which the purpose will be explained below) corresponds to the internal diameter of the tube 11.

The inclined surfaces 25 form ramps enabling the wall of the tube 11 to be deformed to enable the forced sliding of the stopper 12 towards the end 17 of the tube 11.

The straight surfaces 24 form abutments to enable the stopper 12 to resist sliding relative to the tube 11.

The body 9 furthermore has, at the end 18 of the stopper 12, a chamfered edge forming a guide surface 23 inclined towards the interior and towards the end 18 of the stopper 12.

The annular groove 30 is formed on the external surface 28 near the appendix 63.

More specifically, the annular groove 30 is formed between the appendix 63 and the closest annular rib 22.

The annular groove 30 has a concave curved bottom surface.

Figure 12:
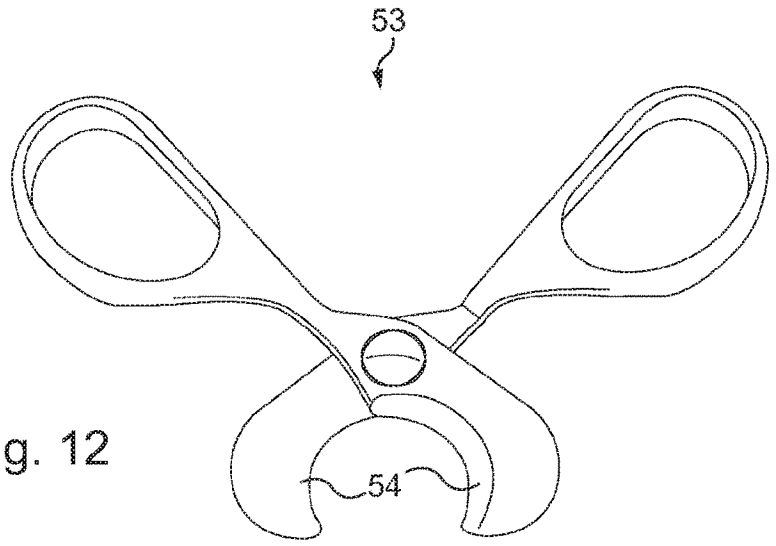
FIG. 12 shows a pair of scissors with curved blades enabling the tube of the straw to be cut at the location of the stopper body.

The annular groove 30 is useful for guiding the cutting of the tube 11, for example with the pair of scissors 53 with curved blades which is illustrated in FIG. 12.

The needle 44 will now be described in more detail with the aid of FIG. 4.

The female tip 45 extends between an end 55 which can be seen on the left in FIG. 4 and an end 56 which can be seen on the right.

The female tip 45 comprises a collar 48 at its end 56.

The needle 44 further comprises a hollow shaft 39 projecting from the female tip 45 from its first end 55.

The internal lumen 40 of the needle 44 extends from the end 56 of the female tip 45 to the point of the hollow shaft 39.

The hollow shaft 39 here has a diameter known as gauge 18 or gauge 20. The needle 44 is of hypodermic type.

In order to engage the female tip 45 on the male tip 29, the annular wall 64 of the appendix 63 has been cut then the closure 33 removed. The tube 11 has been cut at the same place then the cut end portion of the tube 11 removed.

When the female tip 45 is engaged on the male tip 29, the frusto-conical internal surface 46 of the female tip 45 is in contact with and fits to the frusto-conical external surface 14 of the male tip 29.

The internal duct 20 of the male tip 29 opens into the internal lumen 40 of the needle 44.

The straw 10 to which is connected the needle 44 with its female connector tip 45 which has a frusto-conical internal surface 46 that is engaged on the male connector tip 29 of the stopper 12 forms a device for injection of a fluid substance of which the operation is explained later.

A description will now be given of the use of the straw 1 with the aid of FIGS. 5 to 13.

Figure 5:
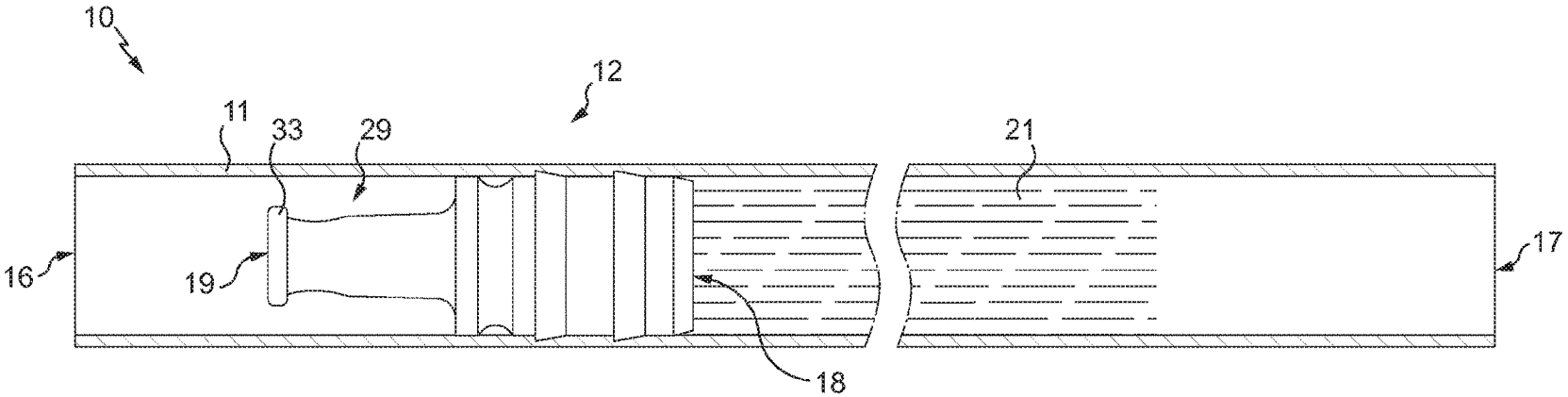
FIG. 5 is a view similar to FIG. 1 but with the straw in the filled state.

The straw 10 illustrated in FIG. 5 comprises a predetermined dose of liquid-based substance 21, here a solution of concentrated vaccine.

The filling of the straw 10 is carried out using a needle (not illustrated), connected to a reservoir (not illustrated) of substance 21, which is inserted into the tube 11 by the end 17 of the tube 11 until its end comes near the stopper 12.

On injection of the substance 21, the needle is progressively retracted.

It will be noted that the substance 21 here does not enter, or enters extremely little, the inside of the internal duct 20 of the stopper 12.

After the filling, the internal duct 20 therefore contains a certain volume of air.

It will be furthermore noted that the volume of the injected predetermined dose is such that there remains a portion of the tube 11 towards the end 17 that is not filled by the substance 21.

The tube 11 is next welded in the neighborhood of its two ends 16 and 17.

In the neighborhood of each end, a weld 41 is formed using two heating jaws (not illustrated) between which an end portion of the tube 11 is crushed by pinching. The portion so crushed takes a flattened position by forming two lips 42 (FIG. 9) placed in contact with each other. Simultaneously with the crushing, the heat transmitted by the heating jaws to the material of the tube 11 (here Surlyn®) leads to the formation of the sealing weld 41 between the two lips 42.

The straw 10 with the tube 11 welded in the neighborhood of its two ends 16 and 17 is illustrated in FIG. 6.

It will be noted that, given that there remains a portion of the tube 11 not filled with the substance 21, an air bubble 43 having a predetermined volume is trapped in the tube 11 between the weld 41 in the neighborhood of the end 17 and the dose of substance 21.

This air bubble 43 is useful on freezing the straw to permit the increase in volume of the substance 21.

Figure 7:
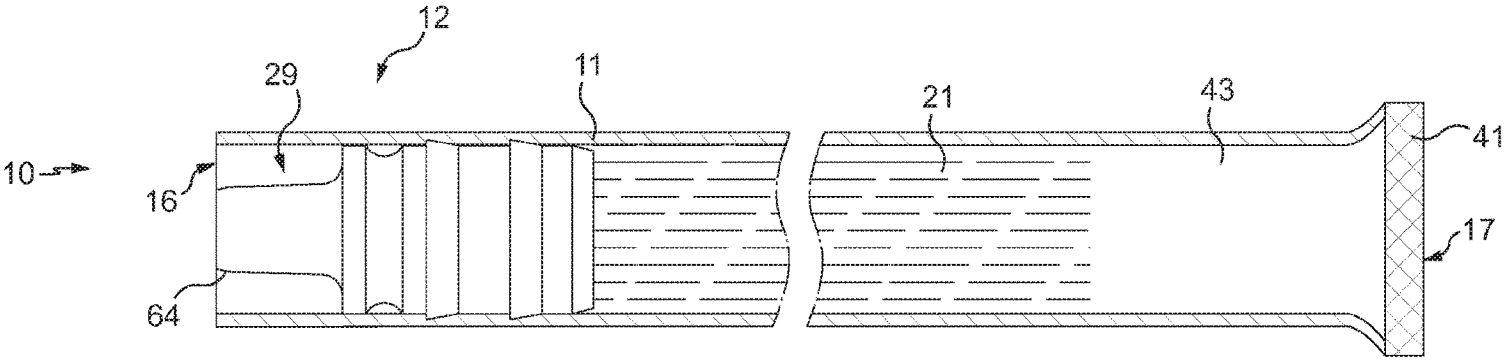
FIG. 7 is a similar view to FIG. 6 but after the closure of the straw's stopper has been cut then removed and its tube has been cut at the same location then the cut end portion of the tube removed.

With the aid of FIGS. 7 to 9, a description will now be given of a first embodiment of the emptying of the straw 10.

To empty the straw 10, the tube 11 is first of all cut between its end 16 and the body 9 of the stopper 12 then the end portion of the tube 11 that has been cut is removed.

The annular wall 64 of the appendix 63 is then cut and the closure 33 removed.

It is possible to cut the tube 11 and the annular wall 64 at the same time, for example with a snip of scissors. The straw 10 is then in the state illustrated in FIG. 7.

The needle 44 having the female tip 45 is next connected to the straw 10.

The hollow shaft 39 of the needle 44 is next, for example, pushed into the septum of a container containing a dilution liquid (for example water for injection) for a solution of concentrated vaccines (these not being illustrated).

To empty the straw 10 in accordance with the first embodiment of emptying, an emptying device (partially illustrated) is employed here comprising two rollers 47 each oriented in the same direction and disposed one beside the other.

The emptying device is configured in order for the rollers 47 to progressively crush the tube 11 from its end 17 towards the stopper 12. The air bubble 43 is thus pushed in the same direction and then in turn pushes the substance 21 which successively enters the internal duct 20 of the stopper 12 and the lumen 40 of the needle 44 until it is expulsed from the needle 44, into the container containing the dilution liquid.

The volume of the air bubble 43 is sufficient to fill the internal duct 20 and the lumen 40 at the moment the rollers 47 are close to the stopper 12. Thus, there is no substance 21 lost in the duct 20 and in the lumen 40, or if there is, very little.

The emptying device comprising the rollers 47 is for example implemented by furthermore providing a body and a rail that is fixedly mounted on the body.

The rollers 47 are slidingly mounted along the rail, with the rollers 47 each oriented transversely to the direction of extension of the rail.

The emptying device is configured to move the rollers 47 apart or towards each other according to the place at which the two rollers 47 are situated on the rail.

The emptying device further comprises a floor that can be elastically withdrawn which is disposed under the rail.

To empty the straw 10, the rollers 47 are initially positioned at a first end of the rail, the access to the floor thus being clear to enable the straw 10 to be disposed there.

The straw is next disposed on the floor, while being oriented in the same direction as the rail and situated substantially between the respective paths of the two rollers 47, with the weld 41 of the straw facing towards the rollers 47.

The needle 44 situated at the other end of the straw is engaged in a conical accommodation formed in the body of the device, with the external surface of the female tip bearing against the internal surface of the conical accommodation.

The rollers 47 are then moved towards the straw 10 and come to be positioned on respective opposite sides of the weld 41 situated in the neighborhood of the end 17 of the straw. The rollers are then away from each other, separated by a distance slightly greater than the thickness of the weld 41 located between them.

Once the weld 41 has been traversed, the rollers 47 continue their travel while coming towards each other to crush the tube 11 of the straw 10. The spacing between the rollers is then substantially equal to twice the thickness of the wall of the tube 11.

The rollers 47 next progressively crush the tube 11 as explained above.

During its travel, the roller 47 closest to the floor (below referred to as lower roller) comes to bear against an inclined surface of the floor, which urges the floor towards its withdrawn position.

The straw 10 is then no longer held by the floor but remains in the same position since it is held by the rollers 47.

When the lower roller 47 reaches its end of travel, that is to say near the stopper 12 of the straw, it is beyond the distal end of the floor which then recovers its initial position under the effect of the elastic member in opposition to which it was withdrawn.

The distal end of the floor then comes to be positioned behind the lower roller 47 and plays the role of a non-return stop for both the rollers 47.

The fact that both the rollers 47 are prevented from reversing once they are near the stopper 12 avoids the tube 11 of the straw 10 returning to its initial form and thereby limits the risk of re-suction of the ejected substance 21.

Figure 10:
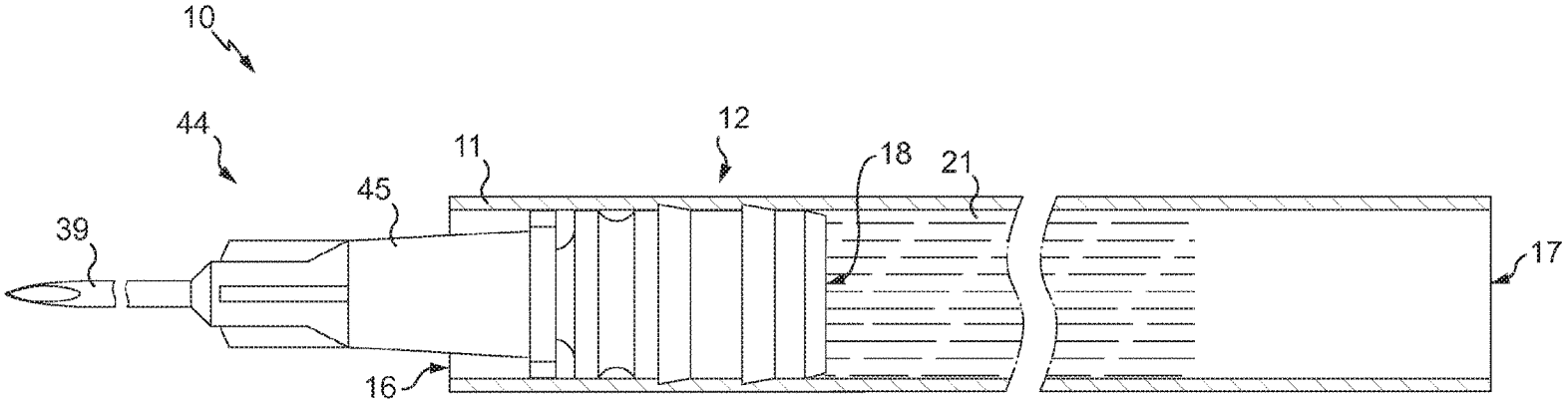
FIG. 10 is a similar view to FIG. 7 but with the other side of the tube also cut and the end portion so cut removed and with a syringe needle connected to the straw's stopper.
Figure 11:
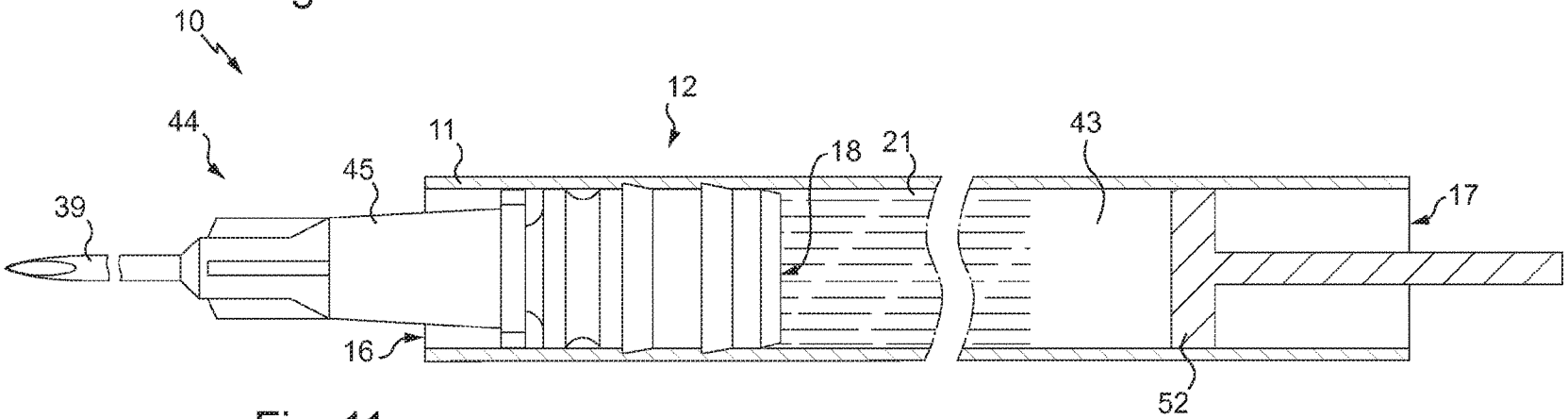
FIG. 11 is a view similar to FIG. 10 but furthermore showing the piston of a device for emptying the straw by sliding the piston in the tube from the end that is the furthest from the stopper.

With the aid of FIGS. 10 to 11, a description will now be given of a second embodiment of the emptying of the straw 10.

The connection of the needle 44 of the straw 10 is carried out as explained above.

Figure 8:
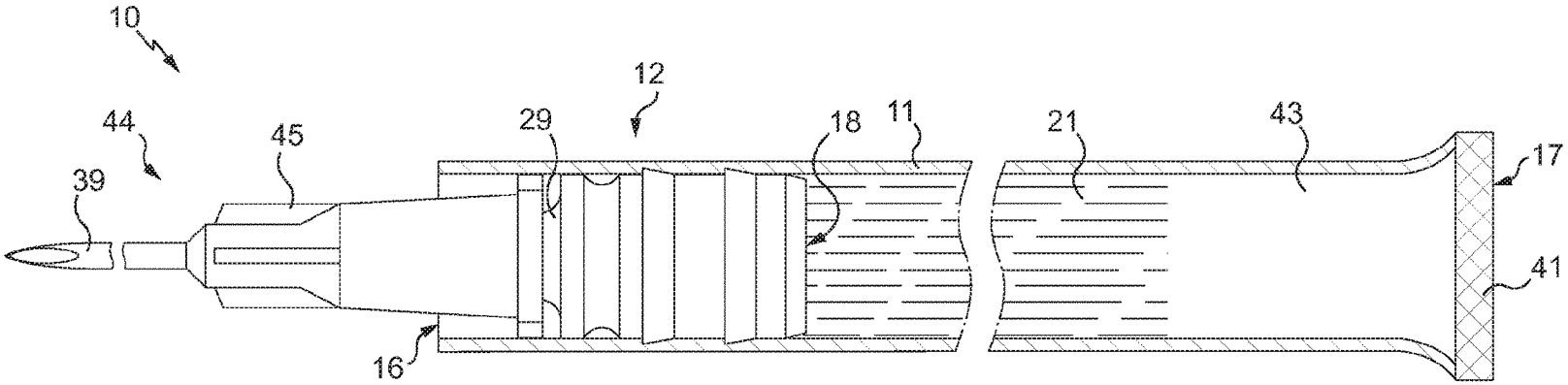
FIG. 8 is a similar view to FIG. 7 apart from the fact that a syringe needle has been connected to the straw's stopper.
Figure 9:
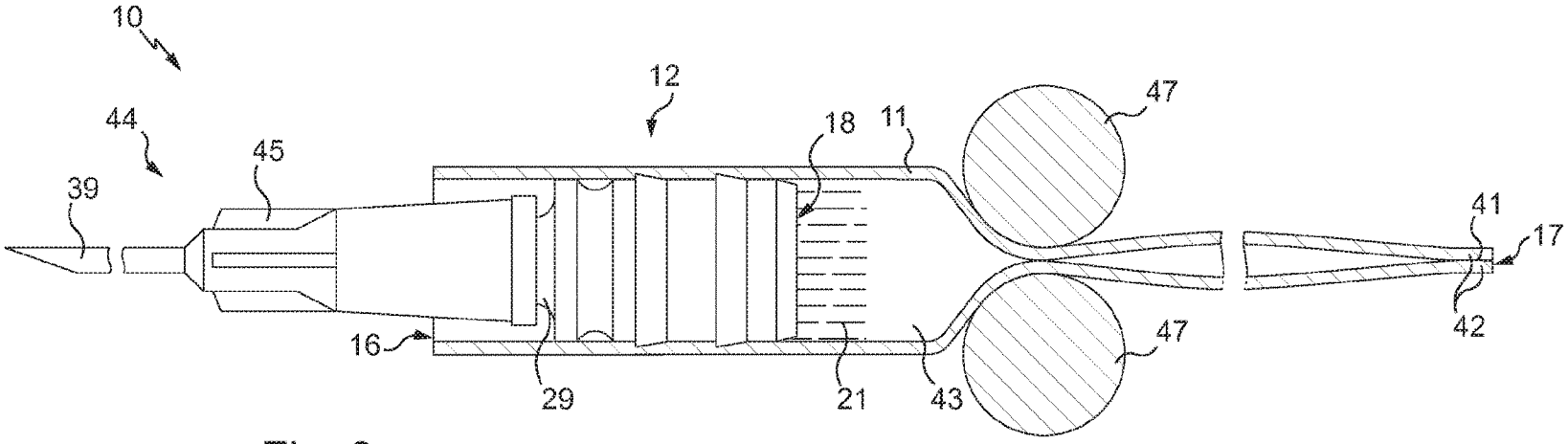
FIG. 9 is a similar view to FIG. 8 but in elevation rather than in plan and showing furthermore the rollers of a device for emptying the straw by progressive crushing of the tube along the tube from the end thereof that is the furthest from the stopper.

Contrary to the embodiment for emptying illustrated in FIGS. 8 and 9, the weld 41 situated in the neighborhood of the end 17 is removed by cutting an end portion flush with that weld 41.

The fact that cutting the tube 11 is carried out flush with that weld 41 enables the air bubble 43 to maintain practically the same volume before and after cutting up.

Rather than employing an emptying device comprising two rollers 47, a device is employed here (partially illustrated) comprising a piston 52.

The piston 52 is moved to push the air bubble 43 which then pushes the substance 21 until it is expulsed out of the needle 44, in the same way as in the embodiment illustrated in FIGS. 8 to 9.

To expose the male tip 29 in order to connect the female tip 45 of the needle 44 thereto, it is possible to cut the tube 11 using a pair of scissors 53 with curved blades 54 (FIG. 12) suitable for cooperating with the annular groove 30 of the stopper 12, the annular groove 30 guiding the movement of the blades 54.

Once the male tip 29 has been exposed it is still necessary to cut the annular wall 64 and remove the closure 33 in order to be able to connect the needle 44.

Once the closure 33 has been removed, the straw 10 is in the state illustrated in FIG. 13.

It can then be emptied.

A description will now be made of a second embodiment of the straw according to the invention, with the aid of FIGS. 14 to 17.

Generally, for parts similar to the embodiment of FIGS. 1 to 13, the same references have been used but with the addition of the number 100.

The inside diameter of the tube 111 is here of the order of 6 mm and the length of the tube 111 is of the order of 130 mm.

The straw 110 has a useful holding capacity here of approximately 2 ml.

The male tip 129 is identical to the male tip 29.

The body 109 of the stopper 112 is identical to the body 9 of the stopper 12, apart from the fact that it has smaller dimensions in order to be able to cooperate with the tube 111 of which the dimensions are smaller than those of the tube 11.

The internal duct 120 of the stopper 112 is entirely frusto-conical here.

Figure 17:
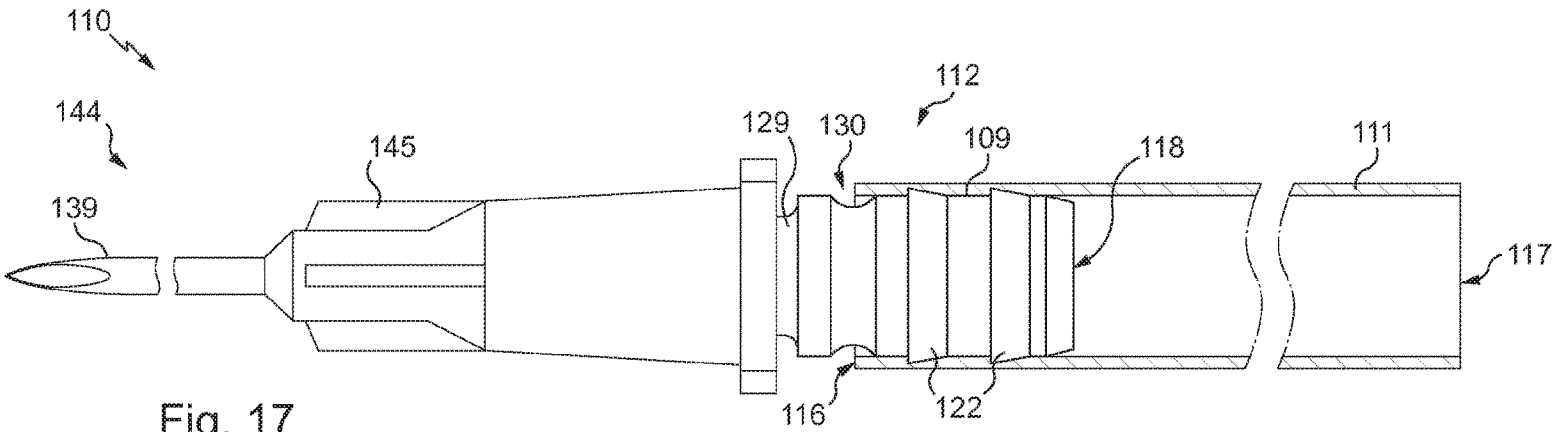
FIG. 17 is a similar view to FIG. 8 but for this variant of the straw with the tube cut at the location of the stopper body.

The use of the straw 110 is identical to the use of the straw 10, the only difference being that, as the tube 111 is very close to the tip 129, the tube 111 is cut at the location of the groove 130 to avoid the tube 111 from hindering the engagement of the tip 145 on the tip 129 (FIG. 17).

Variants of the stopper 12 or 112 will now be described with the aid of FIGS. 18 and 19.

Figure 19:
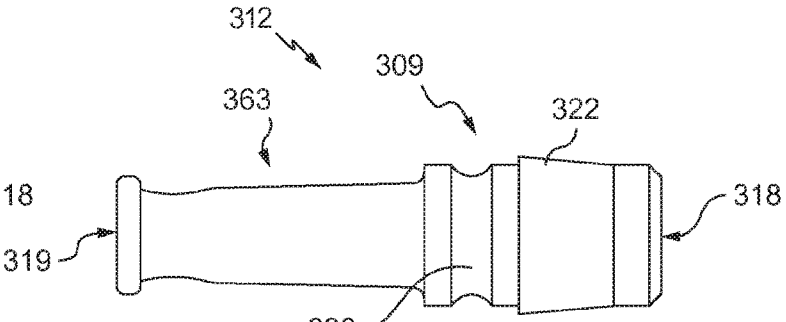
FIGS. 18 and 19 are similar views to FIG. 15 but for variants of the stopper in which the body is differently shaped.
Figure 18:
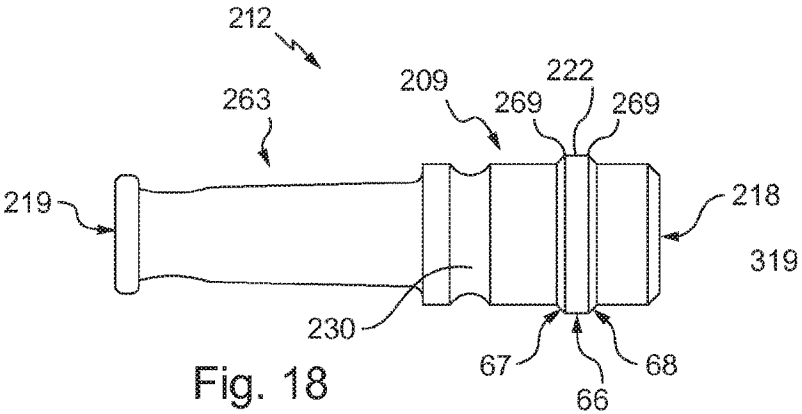

Generally, for parts similar to those of the stopper 12, the same numerical references have been used but with the addition of the number 200 for the variant of FIG. 18 and of the number 300 for the variant of FIG. 19.

The stopper 212 illustrated in FIG. 18 is generally similar to the stopper 112, apart from the fact that the body 209 comprises a single annular rib 222 and that this single annular rib 222 has a different profile to that of the ribs 122 or 22.

Whereas the outermost part of the ribs 22 or 122 is formed by an edge 65 or 165, the outermost part of the rib 222 is formed here by a surface of circular cross-section of uniform diameter 66. The diameter of the surface 66 corresponds to that of the internal surface of the straw's tube.

On opposite sides of the surface 66, the rib 222 has an inclined surface, respectively 67 and 68.

The surface 67 faces towards the first end 219 of the stopper 212 and is inclined towards the first end 219 and towards the interior.

The inclined surface 68 faces towards the second end 218 and is inclined towards the first end 218 and towards the interior.

The stopper 312 illustrated in FIG. 19 is in general terms similar to the stopper 112, apart from the fact that two annular ribs 122 are replaced by a single rib 322 of large axial extent.

In variants not illustrated, the body of the straw's stopper has non-return projections different from the ribs 22, 122 or 322, but which are arranged differently from a rib, for example in the form of a plurality of lugs.

In other variants not illustrated:

- the stopper 12, 112, 212 or 312 is not fully disposed inside the tube of the straw at a predetermined distance from its first end, but projects externally beyond its first end;
- the stopper is rendered fixed relative to the tube other than by mechanical cooperation of surfaces, for example by providing fastening by bonding or welding;
- the tube of the straw is made from several plastic materials, for example by co-extrusion;
- the stopper 12 is made of several materials, for example a relatively flexible material for the appendix and a central part of the body while the periphery of the body is of relatively rigid material;
- the stopper comprises a part permeable to gases and impermeable to liquids, to enable conventional filling, for example the closure is replaced by a tubular part associated with a member permeable to gases and impermeable to liquids such as a conventional three-part stopper;
- the appendix is permeable, for example it does not comprise any closure;
- the stopper body comprises more than two annular ribs, for example three or four ribs;
- the welds made to close the end portions of the straw's tube are disposed at a certain distance from the ends, for example several millimeters; and/or
- the contact members of the device for emptying by crushing the straw's tube are different from rollers such as 47, for example two pressing fingers or an assembly formed by a fixed base and a movable bearing finger.

Numerous other variants are possible according to circumstances, and in this connection it is to be noted that the invention is not limited to the 15 examples described and shown.

The invention claimed is:

1. A straw for the preservation of a predetermined dose of liquid-based substance, comprising a tube extending between a first end and a second end and comprising a fluid-tight stopper disposed in the tube in the neighborhood of its first end and extending between a first end facing towards the first end of the tube and a second end facing towards the second end of the tube, characterized in that said stopper:

- is fixed relative to the tube in a manner that prevents or resists sliding of the stopper in relation to the tube towards the first end of the tube;
- comprises a male connector tip extending between a first end facing towards the first end of the tube and a second end facing towards the second end of the tube, having a frusto-conical external surface in accordance with a standard increasing in diameter from the first end of the tip towards the second end of the tip, the tip being configured in order that a syringe needle having a female connector tip with a frusto-conical internal surface in accordance with a standard can be connected to said stopper by engagement of the female connector tip of the needle on the male connector tip of the stopper with the internal frusto-conical surface of the female tip in contact with the external frusto-conical surface of the male tip; and comprises an internal duct extending between the first end of the tip and the second end of the stopper, the duct extending up to the second end of the stopper such that the duct opens into an internal space of the tube situated between the second end of the stopper and the second end of the tube.

2. A straw according to claim 1, characterized in that, in an initial state prior to use, the first end of the stopper is situated in the tube at a predetermined distance from the first end of the tube enabling the tube to be welded between the first end of the stopper and the first end of the tube.

3. A straw according to claim 1, characterized in that the stopper comprises a body fastened to the tube and an appendix projecting from said body fastened to the tube solely via the body, which appendix comprises said male tip and extends to the first end of the stopper.

4. A straw according to claim 3, characterized in that the body of the stopper and the tube are fastened independently of any contact of the stopper with said liquid-based substance.

5. A straw according to claim 3, characterized in that the body is rigid at least at the periphery and comprises an external surface having non-return projections oriented to enable the forced sliding of the stopper in relation to the tube from the first end towards the second end and to resist the sliding of the stopper in relation to the tube towards the first end of the tube.

6. A straw according to claim 3, characterized in that the body is rigid at least at the periphery and comprises an external surface having at least two annular ribs spaced away from each other.

7. A straw according to claim 3, characterized in that the body comprises on its external surface an annular groove near of the appendix.

8. A straw according to claim 1, characterized in that said male connector tip is a male Luer tip.

9. A straw according to claim 1, characterized in that said stopper is entirely of material impermeable to gases and liquids independently of contact of the stopper with said liquid-based substance.

10. A straw according to claim 1, characterized in that said stopper is entirely of rigid plastic material molded as a single piece.

11. A straw for the preservation of a predetermined dose of liquid-based substance, comprising a tube extending between a first end and a second end and comprising a fluid-tight stopper disposed in the tube in the neighborhood of its first end and extending between a first end facing towards the first end of the tube and a second end facing towards the second end of the tube, characterized in that said stopper:

is fixed relative to the tube;

comprises a male connector tip extending between a first end facing towards the first end of the tube and a second end facing towards the second end of the tube, having a frusto-conical external surface in accordance with a standard increasing in diameter from the first end of the tip towards the second end of the tip, the tip being configured in order that a syringe needle having a female connector tip with a frusto-conical internal surface in accordance with a standard can be connected to said stopper by engagement of the female connector tip of the needle on the male connector tip of the stopper with the internal frusto-conical surface of the female tip in contact with the external frusto-conical surface of the male tip; and comprises an internal duct extending between the first end of the tip and the second end of the stopper;

wherein, in an initial state prior to use, the stopper comprises at its first end a closure to be removed that obturates said internal duct of the stopper.

12. A straw according to claim 11, characterized in that an annular wall is disposed between the closure and the male tip, the internal duct of the stopper extending beyond the first end of the male tip, in the annular wall, to the closure which obturates it, the external surface of the annular wall being set back relative to the external surface of the male tip.

13. A straw for the preservation of a predetermined dose of liquid-based substance, comprising a tube extending between a first end and a second end and comprising a fluid-tight stopper disposed in the tube in the neighborhood of its first end and extending between a first end facing towards the first end of the tube and a second end facing towards the second end of the tube, characterized in that said stopper:

is fixed relative to the tube;

comprises a male connector tip extending between a first end facing towards the first end of the tube and a second end facing towards the second end of the tube, having a frusto-conical external surface in accordance with a standard increasing in diameter from the first end of the tip towards the second end of the tip, the tip being configured in order that a syringe needle having a female connector tip with a frusto-conical internal surface in accordance with a standard can be connected to said stopper by engagement of the female connector tip of the needle on the male connector tip of the stopper with the internal frusto-conical surface of the female tip in contact with the external frusto-conical surface of the male tip; and comprises an internal duct extending between the first end of the tip and the second end of the stopper, the duct extending up to the second end of the stopper such that the duct opens into an internal space of the tube situated between the second end of the stopper and the second end of the tube;

wherein the stopper comprises a body fastened to the tube and an appendix projecting from said body fastened to the tube solely via the body, which appendix comprises said male tip and extends to the first end of the stopper; and wherein the body is rigid at least at the periphery and comprises an external surface having at least one annular rib having a straight surface facing towards the first end of the tube and an inclined surface facing towards the second end of the tube, the inclined surface being inclined towards the interior and towards the second end of the tube.

14. A device for injecting a liquid-based substance comprising a straw according to claim 1 and a syringe needle having a female connector tip with a frusto-conical internal surface engaged on the male connector tip of the stopper of said straw.

15. A method for emptying a straw according to claim 1, comprising a dose of liquid-based substance disposed between the second end of the stopper and the second end of the tube comprising the step of pushing the dose of liquid-based substance towards the first end of the tube after having connected the female tip of a syringe needle onto the male tip of the stopper.

16. A method according to claim 15, characterized in that the step of pushing the dose of liquid-based substance is implemented with the second end of the tube remaining closed while the tube is progressively crushed from the second end of the tube towards the stopper.

17. A method according to claim 15, characterized in that the step of pushing the dose of liquid-based substance is implemented with the second end of the tube being open, by virtue of a piston inserted by that end which is moved towards the stopper.

* * * * *